US009048598B2

(12) United States Patent
Byrne et al.

(10) Patent No.: US 9,048,598 B2
(45) Date of Patent: Jun. 2, 2015

(54) LOW VOLTAGE POWER RECEPTACLE FOR MODULAR ELECTRICAL SYSTEMS

(71) Applicants: Norman R. Byrne, Ada, MI (US); Roger D. Burdi, Grand Rapids, MI (US); Randell E. Pate, Jenison, MI (US); Joseph Castiglione, Rockford, MI (US)

(72) Inventors: Norman R. Byrne, Ada, MI (US); Roger D. Burdi, Grand Rapids, MI (US); Randell E. Pate, Jenison, MI (US); Joseph Castiglione, Rockford, MI (US)

( * ) Notice: Subject to any disclaimer, the term of this patent is extended or adjusted under 35 U.S.C. 154(b) by 0 days.

(21) Appl. No.: 14/261,743

(22) Filed: Apr. 25, 2014

(65) Prior Publication Data

US 2014/0322981 A1 Oct. 30, 2014

Related U.S. Application Data

(60) Provisional application No. 61/817,711, filed on Apr. 30, 2013.

(51) Int. Cl.

| | |
|---|---|
| ***H01R 4/60*** | (2006.01) |
| ***H01R 25/14*** | (2006.01) |
| ***H01R 13/66*** | (2006.01) |

(52) U.S. Cl.

CPC ..... *H01R 25/145* (2013.01); *H01R 13/6675* (2013.01)

(58) Field of Classification Search

CPC .... H01R 25/162; H01R 25/006; H01R 25/16; H01R 31/02; H01R 25/164; H01R 13/514; H01R 2103/00; H01R 31/06; H01R 13/652; H01R 25/00; H01R 25/161; H01R 25/14

USPC ..... 439/210–218

See application file for complete search history.

(56) References Cited

U.S. PATENT DOCUMENTS

| | | | | |
|---|---|---|---|---|
| 1,187,010 | A | 6/1916 | Rodrigues | |
| 2,313,960 | A | 3/1943 | O'Brien | |
| 2,320,332 | A | 5/1943 | Morten | |
| 2,540,575 | A | 2/1951 | Finizie | |
| 4,135,775 | A | 1/1979 | Driscoll | |
| 4,382,648 | A | 5/1983 | Propst | |
| 4,551,577 | A | 11/1985 | Byrne | |
| 4,959,021 | A | 9/1990 | Byrne | |
| 5,013,252 | A | 5/1991 | Nienhuis | |
| 5,073,120 | A | 12/1991 | Lincoln | |
| 5,096,431 | A | 3/1992 | Byrne | |
| 5,096,434 | A | 3/1992 | Byrne | |
| 5,164,544 | A | 11/1992 | Snodgrass | |
| 5,178,555 | A | 1/1993 | Kilpatrick | |
| 5,259,787 | A | 11/1993 | Byrne | |
| 5,582,522 | A | 12/1996 | Johnson | |
| 5,902,148 | A * | 5/1999 | O'Rourke | 439/505 |

(Continued)

*Primary Examiner* — Xuong Chung Trans

(74) *Attorney, Agent, or Firm* — Gardner, Linn, Burkhart & Flory, LLP

(57) ABSTRACT

A low voltage power receptacle assembly is provided for use in a modular electrical system. The receptacle assembly includes a housing that defines an internal cavity for receiving and protecting various high and low voltage electrical components, and for providing convenient access to low voltage power outlets associated therewith. The receptacle assembly houses at least two electrical bus bars that are spaced apart and that conduct line voltage received from a relatively high voltage power input. A low voltage transformer has at least two electrical contacts for engaging the electrical bus bars, and is operable to convert the line voltage to a lower output voltage at the power outlets. An isolator body has a non-conductive wall positioned between the electrical bus bars to maintain electrical isolation thereof.

20 Claims, 10 Drawing Sheets

(56) References Cited

U.S. PATENT DOCUMENTS

| | | | | |
|---|---|---|---|---|
| 6,036,516 | A | 3/2000 | Byrne | |
| 6,111,772 | A * | 8/2000 | Lee et al. | 363/146 |
| 6,540,536 | B1 | 4/2003 | Young | |
| 7,410,379 | B1 | 8/2008 | Byrne | |
| 7,465,178 | B2 | 12/2008 | Byrne | |
| 7,641,510 | B2 | 1/2010 | Byrne | |
| 7,789,686 | B2 * | 9/2010 | Kim | 439/218 |
| 7,905,737 | B2 | 3/2011 | Byrne | |
| 8,444,425 | B2 | 5/2013 | Byrne | |
| 8,496,492 | B2 | 7/2013 | Byrne | |
| 8,585,419 | B2 | 11/2013 | Byrne | |
| 8,736,106 | B2 | 5/2014 | Byrne et al. | |
| 8,790,126 | B2 | 7/2014 | Byrne | |
| 8,801,445 | B2 | 8/2014 | Byrne | |
| 2008/0280475 | A1 | 11/2008 | Byrne | |
| 2013/0095681 | A1 | 4/2013 | Byrne | |
| 2014/0065882 | A1 | 3/2014 | Byrne | |
| 2014/0179132 | A1 | 6/2014 | Byrne | |

* cited by examiner

LOW VOLTAGE POWER RECEPTACLE FOR MODULAR ELECTRICAL SYSTEMS

CROSS REFERENCE TO RELATED APPLICATION

The current application claims the benefit of U.S. provisional application Ser. No. 61/817,711, filed Apr. 30, 2013, which is hereby incorporated herein by reference in its entirety.

FIELD OF THE INVENTION

The present invention relates to low voltage electrical power and/or data outlets or receptacles for use in modular electrical systems.

BACKGROUND OF THE INVENTION

Low voltage power and data outlets, such as Universal Serial Bus ("USB" and "USB Power") outlets, are in increasing demand as the number of electrical and electronic devices that use such outlets continues to increase. Such devices may include, for example, mobile phones, computers and computing devices, digital cameras, communications equipment, and the like. Therefore, there has been increasing demand for access to such outlets in work areas, homes, and even public spaces such as airports, shopping malls, and the like.

SUMMARY OF THE INVENTION

The present invention provides a low voltage power receptacle assembly that is compatible for use in a modular electrical system, such as may be used for providing electrical power in a work area or the like. The low voltage power receptacle assembly includes a power transformer for reducing a line voltage (e.g., 110V AC or 220V AC), that supplies electrical power to standard receptacle outlets, down to a lower voltage (such as about 2V DC to about 12V DC, for example), which is made available to users at a low voltage power receptacle, such as a USB-style receptacle, although other types or configurations of low voltage power receptacles, outlets, or sockets are equally possible. The low voltage power receptacle assembly is compatible for use in multi-circuit modular electrical systems, and may include two or more "hot" electrical conductors, such as bus bars, in order to convey standard line voltage through the low voltage power receptacle assembly, and on to other high or low voltage receptacles or other couplers or power consumers.

According to one form of the present invention, a low voltage power receptacle assembly is provided for use in a modular electrical system. The low voltage power receptacle assembly includes a housing, at least two electrical bus bars, a low voltage transformer, and an isolator body. The housing defines a cavity for receiving other components of the assembly, including the bus bars, the transformer, and the isolator body. The electrical bus bars are spaced apart from one another and extend through the housing cavity. The electrical bus bars conduct a line voltage that is received from a power input, and an elongate space is defined between the bus bars. The isolator body includes an elongate non-conductive wall that is positioned in the elongate space between the electrical bus bars. The low voltage transformer includes at least two electrical contacts and a low voltage power receptacle. The electrical contacts engage the respective electrical bus bars, and the low voltage transformer is operable to transform or convert the line voltage received at the electrical contacts to a lower voltage output at the low voltage power receptacle.

In one aspect, the housing is a two-piece housing including a front housing piece and a rear housing piece. The front housing piece defines an opening that is aligned to permit access to the low voltage power receptacle by an electrical connector associated with an electrical consumer.

In another aspect, the low voltage power receptacle assembly includes a coupler portion disposed at an end portion of the electrical bus bars for engaging an electrical connector that is in electrical communication with a power supply. The electrical connector is thus configured to be electrically connected to the electrical bus bars at the coupler portion. Optionally, the housing defines the coupler portion.

In yet another aspect, the receptacle assembly further includes a second coupler portion at an opposite end of the electrical bus bars from the first coupler portion, and configured to engage a second electrical connector that is in electrical communication with a high voltage power outlet receptacle configured to carry the line voltage. The second electrical connector can thus be electrically connected to the electrical bus bars at the second coupler portion.

In a further aspect, the electrical bus bars include a hot bus bar and a neutral or ground bus bar. Optionally, the electrical contacts of the low voltage transformer include a hot electrical contact and a neutral or ground electrical contact. Optionally, the neutral or ground bus bar includes a neutral bus bar, the low voltage power receptacle assembly further including a ground bus bar spaced from the hot bus bar and from the neutral bus bar, and wherein a second elongate space is defined between the ground bus bar and at least one of the hot bus bar and the neutral bus bar.

In still another aspect, the isolator body includes a second elongate non-conductive wall disposed in the second elongate space.

In a still further aspect, each of the electrical contacts of the low voltage transformer is positioned between one of the elongate non-conductive walls and a respective one of the electrical bus bars. Optionally, the at least two electrical contacts include compressible resilient contacts, and each of the at least two electrical contacts is compressed between one of the elongate non-conductive walls and the respective one of the electrical bus bars.

In another aspect, one of the at least two electrical bus bars includes a hot bus bar having a first or second configuration, and the housing and the isolator body are configured to receive the hot bus bar in either of the first and second configurations.

In a further aspect, the at least two electrical contacts of the low voltage transformer include first, second, and third electrical contacts, the first and second electrical contacts including hot contacts and the third electrical contact including a neutral or ground contact. In this arrangement, the first electrical contact is configured to electrically engage the hot bus bar in the first configuration while the second electrical contact remains electrically isolated, and the second electrical contact is configured to electrically engage the hot bus bar in the second configuration while the first electrical contact remains electrically isolated.

Optionally, the line voltage is about 110V AC or about 220V AC, and wherein the lower voltage output at the low voltage power receptacle is between about 2V DC and about 12V DC. The low voltage power receptacle may be a USB receptacle and, optionally, the power receptacle assembly may include a high voltage AC power receptacle.

Thus, the low voltage power receptacle assembly of the present invention provides convenient access to low voltage power, such as may be used for charging and/or providing power to low voltage electrical consumers, such as mobile phones, computers, and computing devices, digital cameras, communications equipment, etc., in a manner that presents a finished appearance, and in a modular system that also permits reconfiguration and/or customization of the various high voltage and low voltage receptacles that may be provided within the system. Users are thus provided with access to low voltage charging or power outlets such as USB-style outlets, without need for separate low voltage wiring systems in addition to a separate high voltage power system.

These and other objects, advantages, purposes and features of the present invention will become apparent upon review of the following specification in conjunction with the drawings.

DESCRIPTION OF THE PREFERRED EMBODIMENTS

A low voltage power receptacle assembly is provided for use within a modular electrical system, which is configurable to provide both high voltage line power (e.g., 110V AC or 220V AC) electrical power at standard power receptacles, while also providing low voltage power (e.g., 2V DC to 12V DC) within the same modular electrical system, which may be incorporated into raceways or other areas to provide electrical power in work areas or the like. As will be described in more detail below, the modular electrical system may be configured, reconfigured, and customized to provide a desired number of both high and low voltage outlets within a desired area, and may even incorporate or accommodate two or more circuits to increase the capacity of the system.

Figure 1:
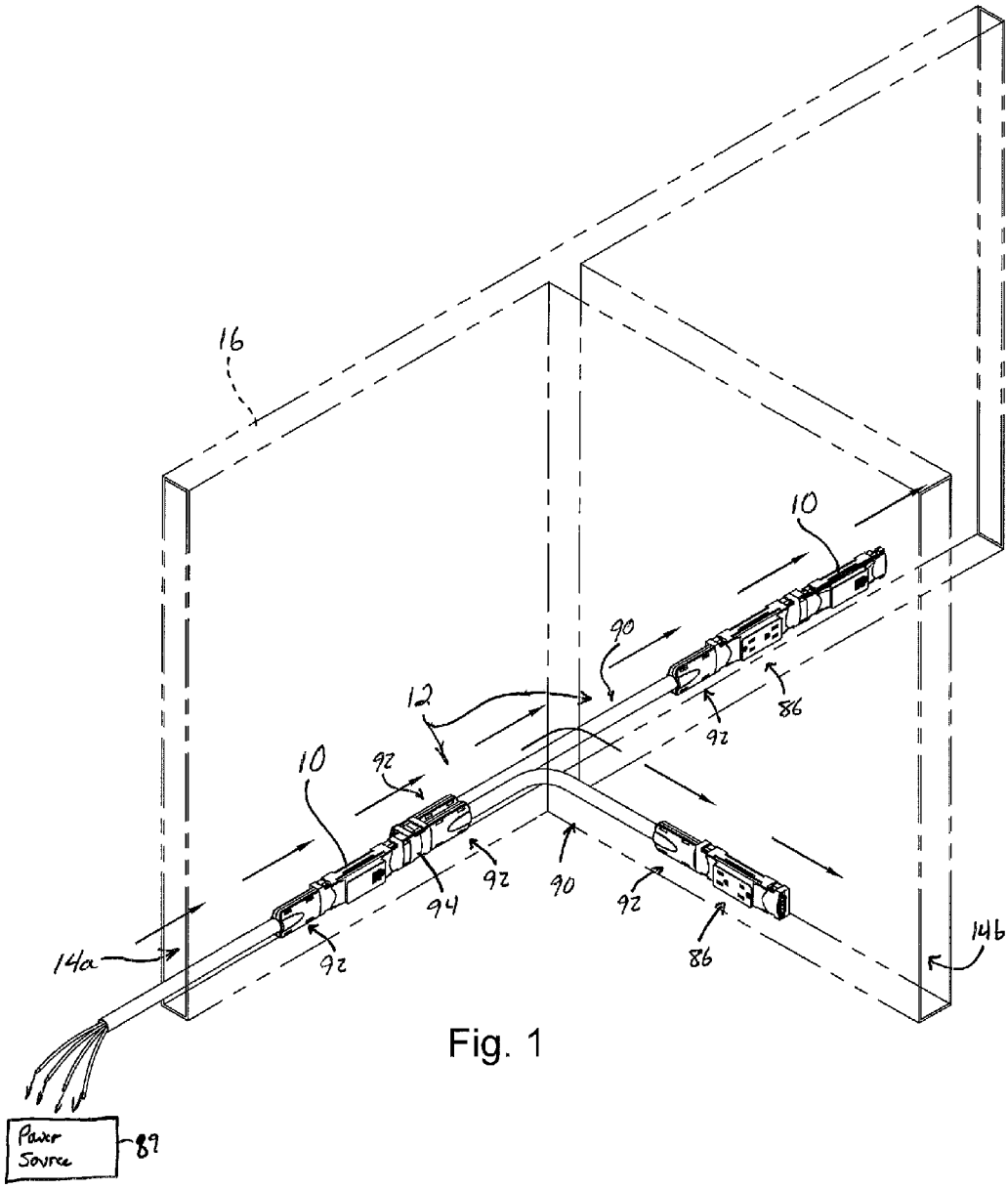
FIG. 1 is a perspective view of a low voltage power receptacle in accordance with the present invention, shown coupled to a modular electrical system in a raceway.
Figure 2:
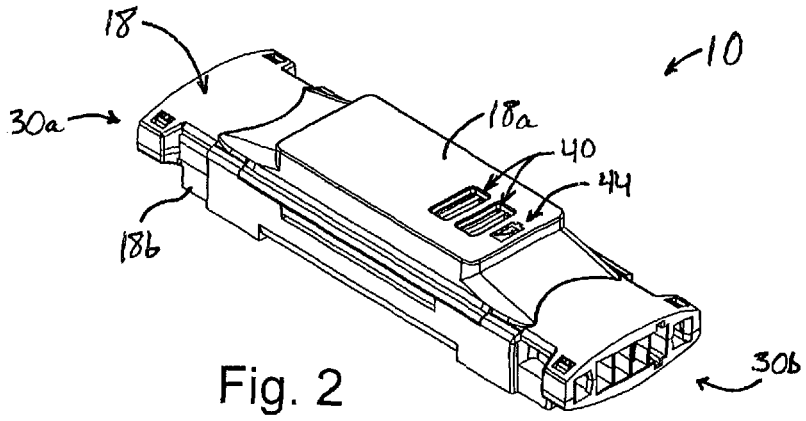
FIG. 2 is a front perspective view of the low voltage power receptacle of FIG. 1, as viewed from a downstream end thereof.
Figure 3:
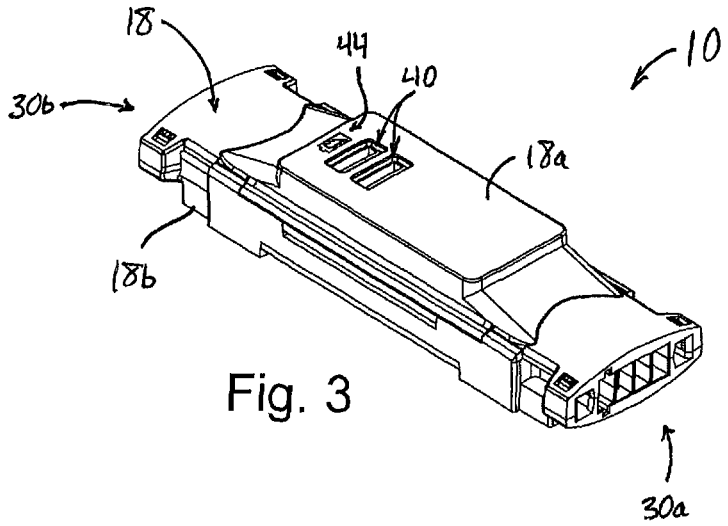
FIG. 3 is another front perspective view of the low voltage power receptacle of FIG. 2, as viewed from an upstream end thereof.
Figure 4:
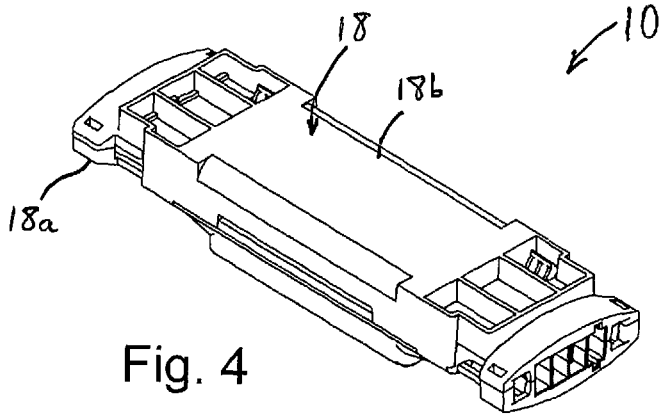
FIG. 4 is a rear perspective view of the low voltage power receptacle of FIG. 2.
Figure 5:
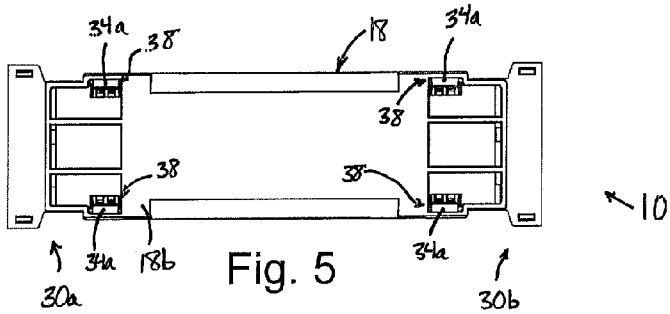
FIG. 5 is a bottom plan view of the low voltage power receptacle of FIG. 2.
Figure 6:
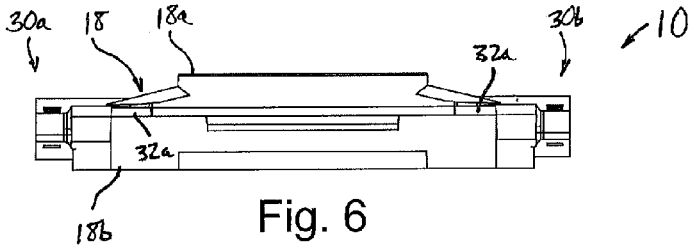
FIG. 6 is a left side elevation of the low voltage power receptacle of FIG. 2.
Figure 7:
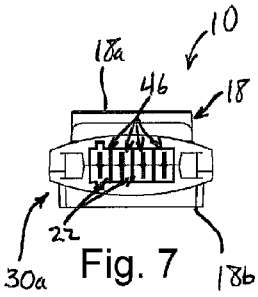
FIG. 7 is an upstream end elevation of the low voltage power receptacle of FIG. 2.
Figure 8:
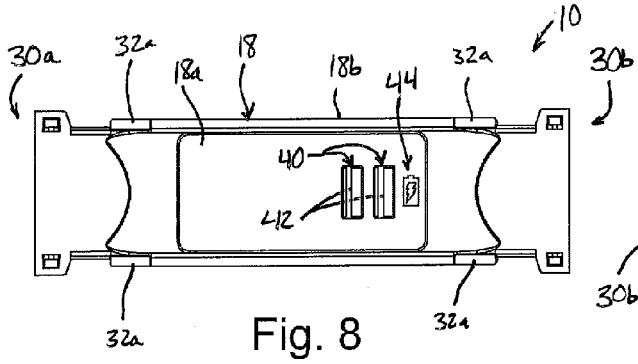
FIG. 8 is a top plan view of the low voltage power receptacle of FIG. 2.
Figure 9:
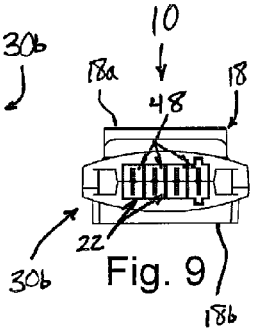
FIG. 9 is a downstream end elevation of the low voltage power receptacle of FIG. 2.
Figure 11:
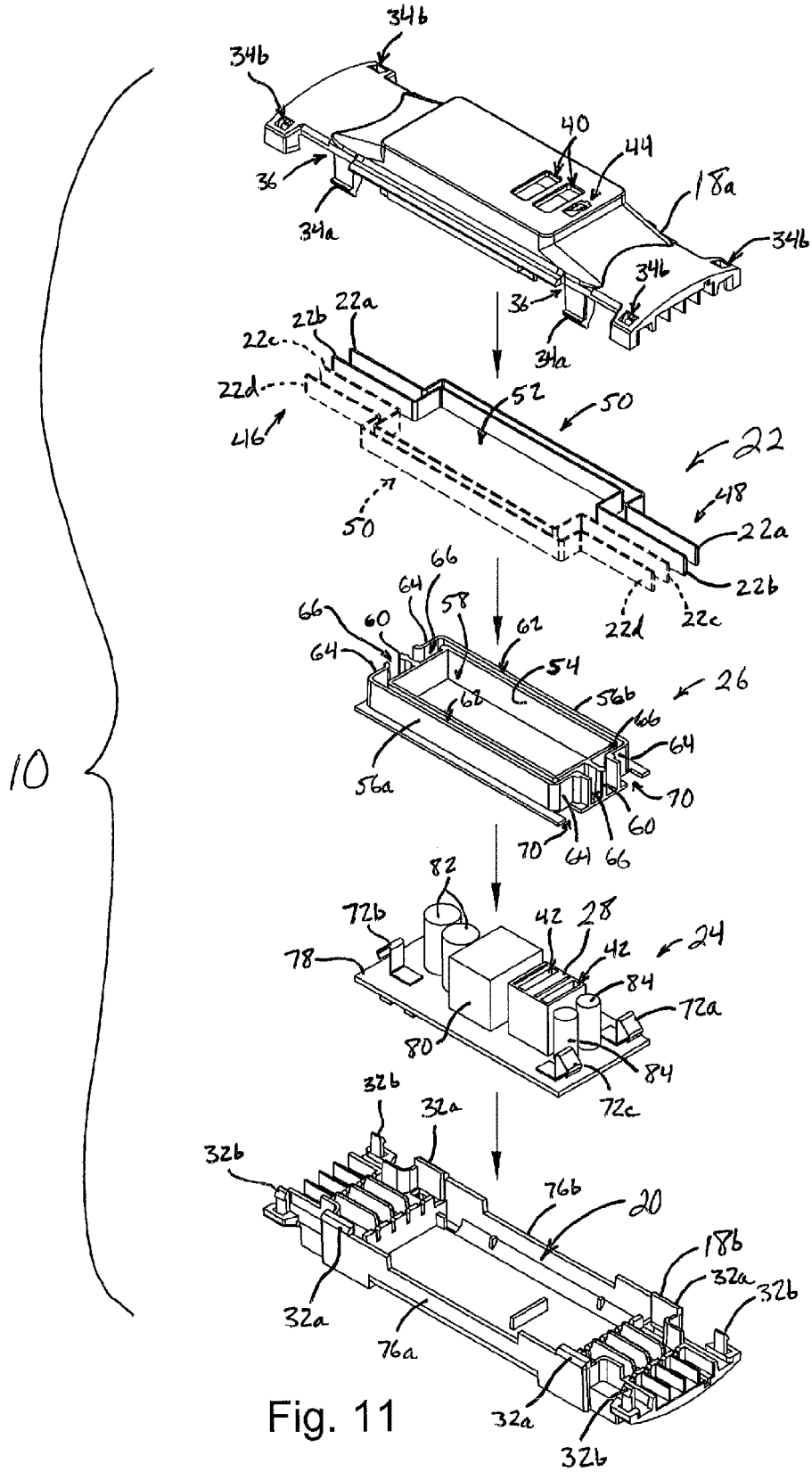
FIG. 11 is an exploded perspective view of the low voltage power receptacle of FIG. 2, as viewed from a downstream end thereof.
Figure 12:
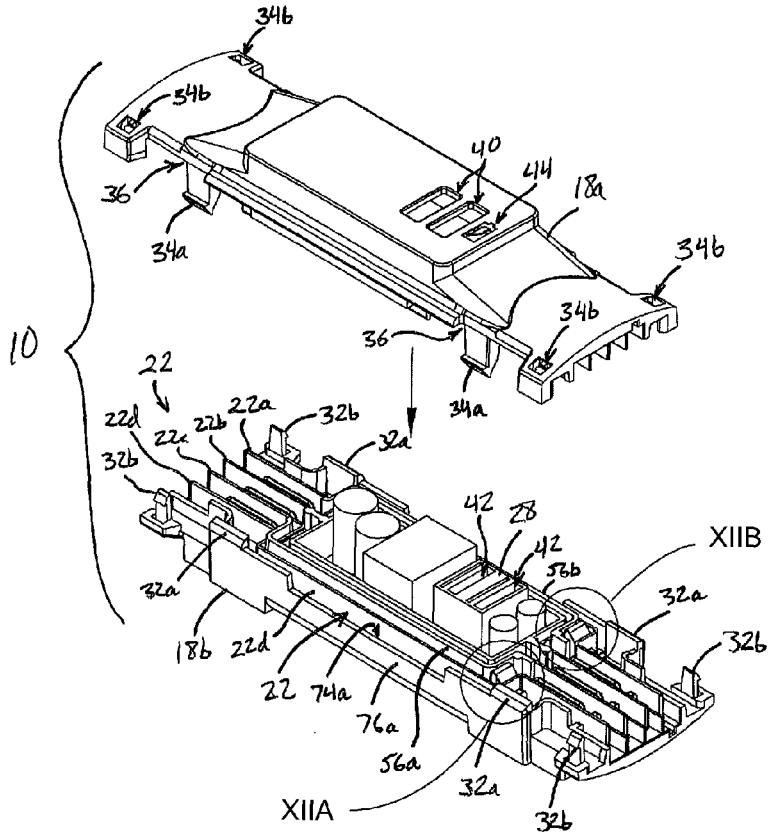
FIG. 12 is a partially exploded perspective view of the low voltage power receptacle of FIG. 2, as viewed from a downstream end thereof.
Figure 13:
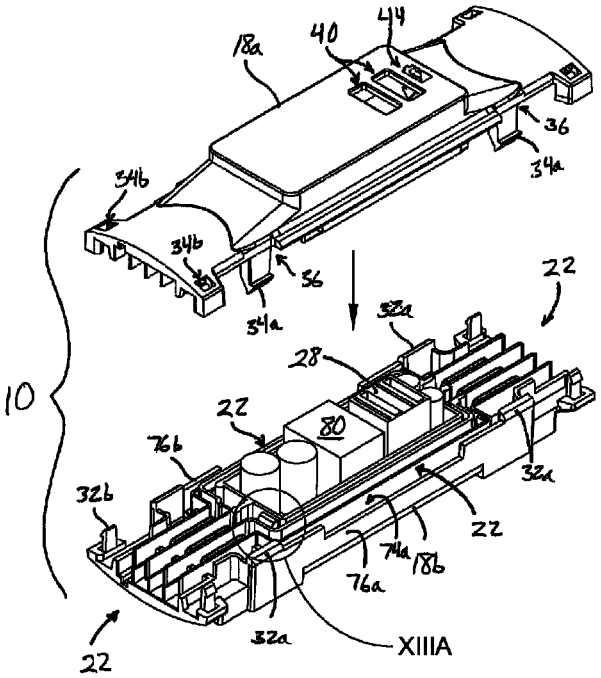
FIG. 13 is another partially exploded perspective view of the low voltage power receptacle of FIG. 2, as viewed from an upstream end thereof.

Referring now to the drawings and the illustrative embodiments depicted therein, a low voltage power receptacle assembly 10 is configured for installation in a modular electrical system 12, which may be routed through one or more raceways 14A, 14B within an area such as a work space defined by walls 16, such as shown in FIG. 1. Power receptacle assembly 10 includes a two-piece housing 18 having a front housing piece 18A and a rear housing piece 18B, such as shown in FIGS. 2-4, 11, 12, and 13. Housing 18 defines an internal cavity 20 between internal surfaces of front housing piece 18A and rear housing piece 18B, such as shown in FIG. 11. Cavity 20 receives other components of receptacle assembly 10, including a plurality of electrical bus bars 22, a low voltage transformer or transformer assembly 24, and an isolator body 26 (FIGS. 11, 12, and 13). As will be described in more detail below, low voltage transformer 24 receives electrical power from electrical bus bars 22, which carry line voltage, typically 110V AC or 220V AC, and converts the high voltage power to a low voltage output at at least one low voltage receptacle 28, while isolator body 26 isolates bus bars 22 from one another and from low voltage circuitry, and also helps to ensure sufficient electrical contact between low voltage transformer 24 and the electrical bus bars 22.

Housing 18 includes a power input coupler portion 30*a* and a power output coupler portion 30*b*, such as shown in FIGS. 2-10, and may be made from molded resinous plastic, for example, or any other suitable material. Front housing piece 18*a* and rear housing piece 18*b* cooperate to define the power input and power output coupler portions 30*a*, 30*b*, and in the illustrated embodiment, the housing pieces are secured together via a plurality of engagement members, which include four main engagement tabs 32*a* and four coupler-end hook portions 32*b* that are integrally or unitarily formed with rear housing piece 18*b* (FIGS. 11, 12, and 13). Front housing piece 18*a* includes four main hook portions 34*a*, and four coupler-end receiving portions 34*b*, which receive coupler-end hook portions 32*b* of rear housing piece 18*b*. Coupler-end hook portions 32*b* snap into engagement with coupler-end receiving portions 34*b*, while main engagement tabs 32*a* of rear housing piece 18*b* engage respective recess areas 36 formed in front housing piece 18*a* (FIGS. 11, 12, and 13), and main hook portions 34*a* of front housing piece 18*a* engage hook-receiving surfaces 38 of rear housing piece 18*b*, such as also shown in FIGS. 2-6, 8, and 10-13A.

Power input coupler portion 30*a* and power output coupler portion 30*b* may be substantially similar or substantially identical to couplers that are shown and described in commonly-owned and co-pending U.S. patent application Ser.

No. 13/647,992, filed Oct. 9, 2012 (U.S. Publication No. 2013/0095681), which is hereby incorporated herein by reference in its entirety. In the illustrated embodiment, front housing piece 18*a* defines two generally rectangular openings 40 that provide access to respective receptacle openings 42 of low voltage receptacle 28. Optionally, an indicia marking 44 may be provided on front housing piece 18*a*, near rectangular openings 40, to inform users of the type of power and/or connectors that are provided at receptacle assembly 10.

Electrical bus bars 22 include a neutral bus bar 22*a*, a ground bus bar 22*b*, and one of two possible "line" or "hot" bus bars 22*c* and 22*d*, such as shown in FIG. 11. Each of the electrical bus bars 22 has a pair of opposite end portions, including an input end portion 46 and an output end portion 48, which are housed in power input coupler portion 30*a* and power output coupler portion 30*b* of housing 18, respectively, such as shown in FIGS. 7, 9, 11, 12, 13, and 17A. Located between input end portions 46 and output end portions 48 of bus bars 22 are respective laterally outwardly-extending middle portions 50 that cooperate to define a generally rectangular open space 52 between the respective middle portions 50 of ground bus bar 22*b* and either first hot bus bar 22*c* and second hot bus bar 22*d*, whichever is present (FIG. 11). In the event that both first and second bus bars 22*c*, 22*d* are present, then the open space 52 would be defined between the respective middle portions 50 of ground bus bar 22*b* and second hot bus bar 22*d*, the latter being located inboard of first hot bus bar 22*c*, such as shown in FIGS. 12 and 13. Rectangular open space 52 provides clearance for various electrical components of low voltage transformer 24, which will be described in more detail below.

Figure 14:
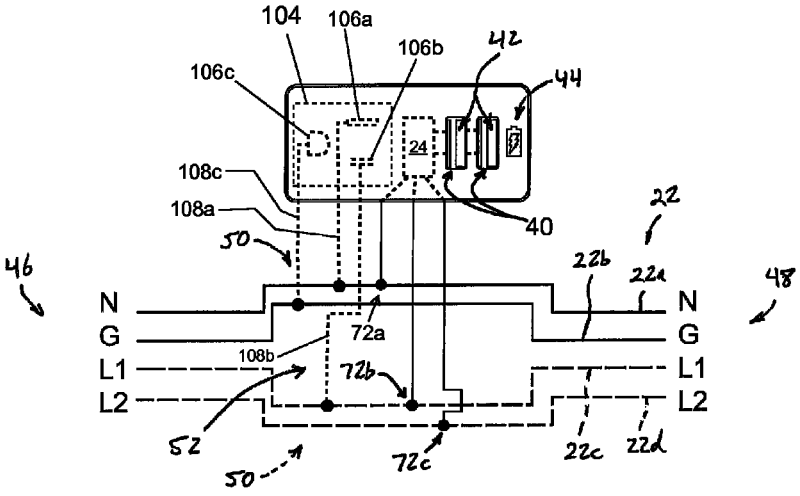
FIG. 14 is a simplified wire diagram showing electrical connections of the low voltage power receptacle of FIG. 2.
Figure 15:
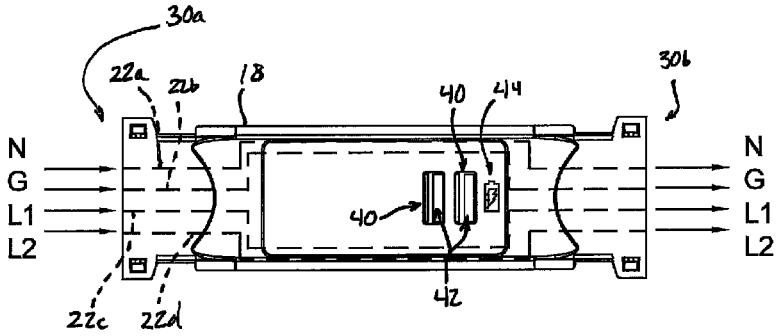
FIG. 15 is another top plan view of the low voltage power receptacle of FIG. 2, with electrical bus bars shown in phantom.

First hot bus bar 22*c* and second hot bus bar 22*d* are illustrated using phantom lines in FIGS. 11 and 14 to denote that, optionally, one of the first and second hot bus bars 22*c*, 22*d* could be omitted in a given low voltage power receptacle assembly 10. First hot bus bar 22*c* is functionally identical to second hot bus bar 22*d*, and differs only in that (1) first hot bus bar 22*c* is shaped for positioning at a more inboard location (and may be substantially identical in shape to ground bus bar 22*b*, but arranged in a mirror-image thereto), and (2) the use of first hot bus bar 22*c* would supply electrical current to the receptacle assembly 10 via a first circuit associated with input end portion 46 of first hot bus bar 22*c*, while the position of second hot bus bar 22*d* would associate it with a second circuit, such as shown in FIG. 15. Second hot bus bar 22*d* may be substantially identical in shape to neutral bus bar 22*a*, but arranged in a mirror-image thereto.

Figure 11A:
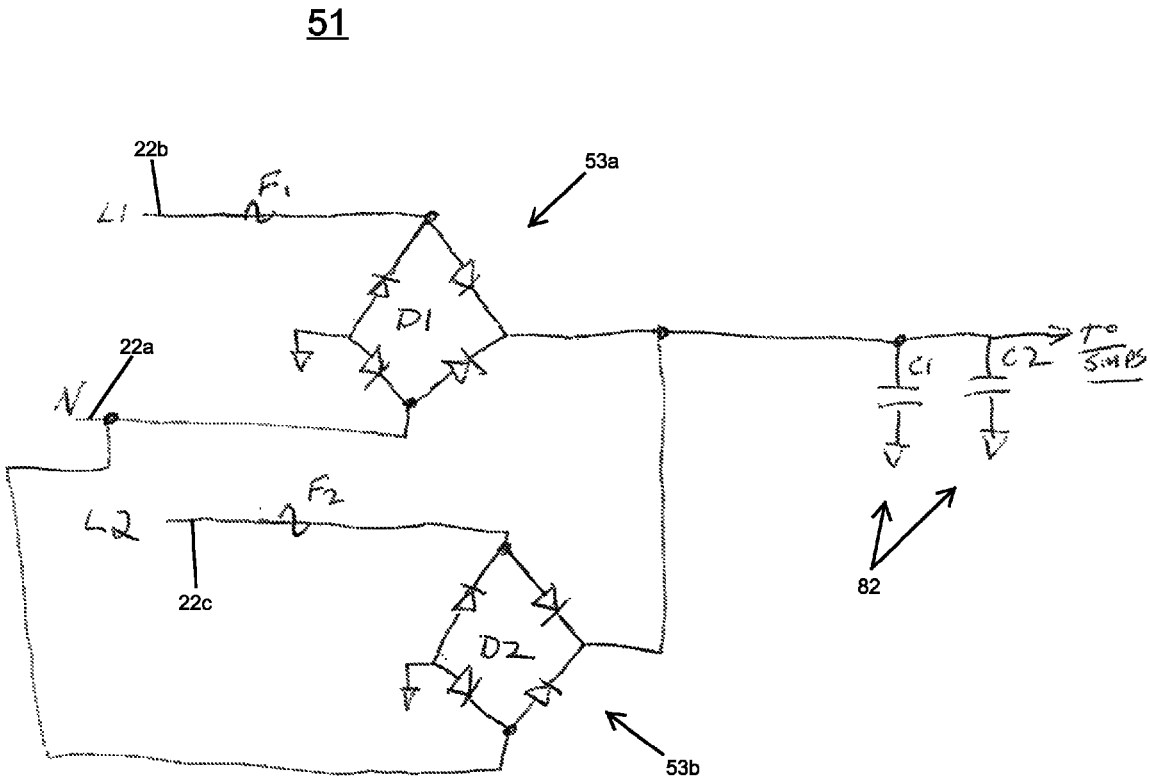
FIG. 11A is a wire diagram of low voltage transformer circuitry associated with the low voltage power receptacle.

Although both first hot bus bar 22*c* and second hot bus bar 22*d* are illustrated using solid lines in FIGS. 7, 9, 12, 13, 17, and 17A, which may be a standard arrangement, it will be appreciated that this arrangement is merely exemplary, and only one of the hot bus bars 22*c*, 22*d* would be needed in the receptacle assembly for it to function properly. It is envisioned that both hot bus bars 22*c*, 22*d* could be included, and either or both could be electrically energized, while still permitting the low voltage power receptacle assembly 10 to function in a desired manner, such as by providing a suitably-adapted low voltage transformer. When both hot bus bars 22*c*, 22*d* are included, the hot bus bars are electrically isolated from one another in circuitry 51 (FIG. 11A) that is associated with low voltage transformer assembly 24. Circuitry 51 includes a pair of separate diode bridges, including a first diode bridge 53*a* associated with first hot bus bar 22*c* and neutral bus bar 22*a*, and a second diode bridge 53*b* associated with second hot bus bar 22*d* and neutral bus bar 22*a*.

Isolator body 26 includes three separate upstanding walls or wall portions, including an inboard generally rectangular wall portion 54 and a pair of separate and generally U-shaped outboard wall portions 56*a*, 56*b*, such as shown in FIG. 11. Inboard rectangular wall portion 54 defines a generally rectangular opening 58 and has a pair of opposite longitudinally-extending wall projections 60. Outboard wall portions 56*a*, 56*b* have elongate middle regions that are spaced from (and substantially parallel to) corresponding longitudinal walls of inboard rectangular wall portion 54, with elongate longitudinal gaps or spaces 62 defined between the middle regions of outboard wall portions 56*a*, 56*b* and the corresponding longitudinal wall portions of inboard rectangular wall portion 54.

At opposite ends of each outboard wall portion 56*a*, 56*b* is a respective laterally-inwardly directed wall end portion 64, which is spaced longitudinally from (and generally parallel to) respective lateral end walls of inboard rectangular wall portion 54. Wall end portions 64 terminate at respective locations that are spaced laterally outwardly from the wall projections 60 of inward rectangular wall portion 54, and are spaced from the lateral end walls of inboard rectangular wall portion 54 in order to form channels 66 with open ends defined between wall projections 60 and wall end portions 64, and which are contiguous with respective elongate spaces 62. A generally planar flange or mounting portion 68 extends laterally outwardly from outboard wall portions 56*a*, 56*b*, and is received in rear housing piece 18*b* during assembly. Flange portion 68 is formed with notches 70 in its opposite ends (FIG. 11), which provide clearance for respective electrical contacts 72*a-c* of low voltage transformer 24. Flange portion 68 may be unitarily formed with inboard rectangular wall portion 54 and outboard wall portions 56*a*, 56*b*, and is made of a non-conductive material, such as injection molded resinous plastic or the like.

Elongate spaces 62 and channels 66 are configured or shaped to receive respective ones of the ground bus bar 22*b* and first hot bus bar 22*c*, while outboard wall portion 56*a* defines a first outboard channel 74*a* between itself and a first side wall 76*a* of rear housing piece 18*b*, and outboard wall portion 56*b* cooperates with a second side wall 76*b* of rear housing piece 18*b* to define a second outboard channel 74*b*. First outboard channel 74*a* is configured to receive second hot bus bar 22*d*, while second outboard channel 74*b* is configured to receive neutral bus bar 22*a*, such as shown in FIGS. 12-12B.

Low voltage transformer 24 includes a substantially planar base 78 to which various electrical components are mounted, including electrical contacts 72*a-c*, low voltage receptacle 28, a low voltage switching power supply transformer 80, power input capacitors 82, and power output capacitors 84. Neutral electrical contact 72*a* and one of first hot electrical contact 72*b* and second hot electrical contact 72*c* bring high voltage electrical power (typically 110V AC or 220V AC current) to low voltage transformer 24 from an electrical power source. From the electrical contacts, the high voltage power is passed through power input capacitors 82, which filter the high voltage power before passing it along to low voltage switching power supply transformer 80. Transformer 80 is operable to transform the high voltage power input to an unfiltered low voltage output, such as about 2V DC to about 12V DC. The unfiltered low voltage output is then passed through power output capacitors 84, which are operable to filter the power from transformer 80 and supply the filtered low voltage power output to low voltage receptacle 28, where users may access the low voltage power by coupling a cable or device to one of receptacle openings 42.

In the illustrated embodiment, transformer 80 is a USB switching power supply transformer with a low voltage output of about 5V DC, although it will be appreciated that substantially any suitable electrical transformer may be used without departing from the spirit and scope of the present invention. In addition, the low voltage receptacle 28 of the illustrated embodiment is a USB power receptacle with socket-style USB receptacle openings 42 housing respective electrical contacts as is known in the art, but it is envisioned that substantially any type of low voltage receptacle, terminals, or coupling may be used.

Figure 10:
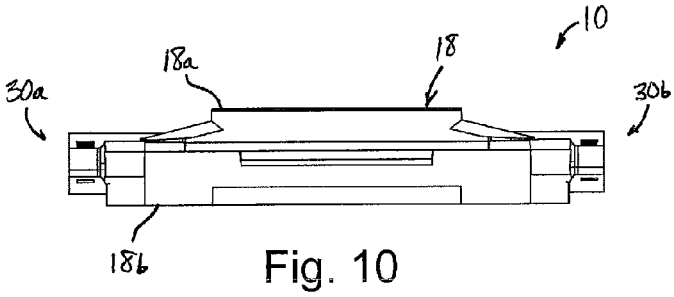
FIG. 10 is a right side elevation of the low voltage power receptacle of FIG. 2.

Referring now to FIGS. 10, 11, and 12, low voltage receptacle 28, low voltage switching power supply transformer 80, power input capacitors 82, and power output capacitors 84 are positioned along a top or front surface of base 78, and are mounted in sufficiently close proximity to one another that they are positionable within the generally rectangular opening 58 formed in isolator body 26, as well as within the generally rectangular opening or space 52 formed between the arrangement of electrical bus bars 22. However, electrical contacts 72*a-c* are all positioned outside of inboard rectangular wall portion 54 and, thus, outside of rectangular opening 58. Neutral electrical contact 72*a* is also positioned outside of ground bus bar 22*b* and, thus, outside of the rectangular opening 52.

Electrical contacts 72*a-c* are made of resilient metal with spring-like properties, and may be substantially similar to the electrical contacts that are commonly used to electrically and mechanically engage the positive and negative terminals of electrical cells ("batteries") in portable electronic devices or other devices that use replaceable batteries. Electrical contacts 72*a-c* are arranged or positioned along base 78 so that when first hot bus bar 22*c* and second hot bus bar 22*d* are both installed, then first hot electrical contact 72*b* will be partially compressed between the inboard surface of first hot bus bar 22*c* and the outboard surface of inboard rectangular wall portion 54 (FIG. 13A), thereby making an electrical connection to first hot bus bar 22*c*, while second hot electrical contact 72*c* will be partially compressed between the inboard surface of second hot bus bar 22*d* and the outboard surface of outboard wall portion 56*a* (FIG. 12A), thereby making an electrical connection to second hot bus bar 22*d*.

Figure 12A:
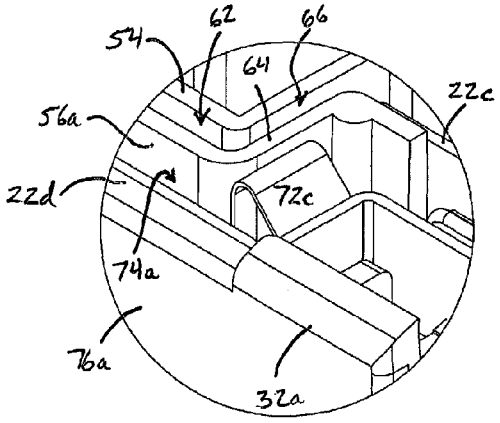
FIGS. 12A and 12B are enlarged views of the areas designated XIIA and XIIB, respectively, in FIG. 12.
Figure 12B:
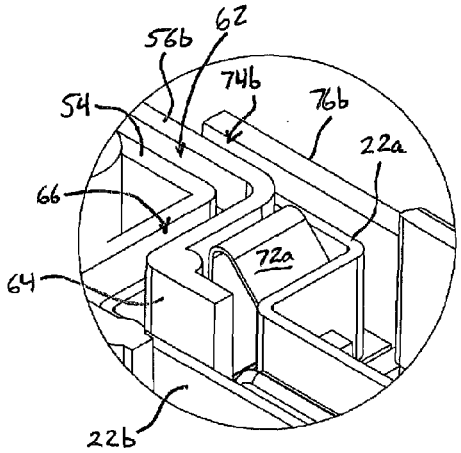

In the event that first hot bus bar 22*c* is installed and second hot bus bar 22*d* is not installed, first hot electrical contact 72*b* is partially compressed between an inboard surface of first hot bus bar 22*c* and an outboard surface of inboard rectangular wall portion 54 (FIG. 13A), thereby making an electrical connection to first hot bus bar 22*c*, while second hot electrical contact 72*c* remains electrically isolated (i.e., no electrical contact is made between contact 72*c* and any bus bar 22, although this arrangement is not shown in FIG. 12A).

Figure 13A:
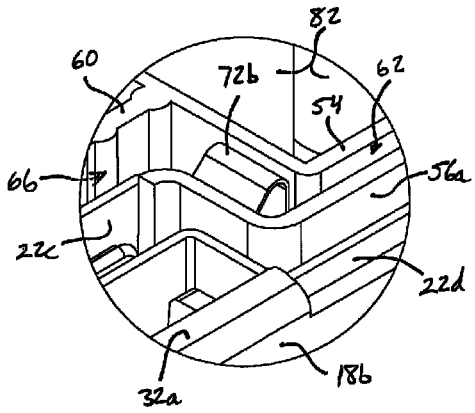
FIG. 13A is an enlarged view of the area designated XIIIA in FIG. 13.

In contrast, when first hot bus bar 22*c* is not installed and second hot bus bar 22*d* is installed, first hot electrical contact 72*b* remains electrically isolated (i.e., no electrical contact is made between contact 72*b* and any bus bar 22, although it should be noted that this arrangement is not shown in FIG. 13A), while second hot electrical contact 72*c* is partially compressed between an inboard surface of second hot bus bar 22*d* and an outboard surface of outboard wall portion 56*a* (FIG. 12A), thereby making an electrical connection to second hot bus bar 22*d*.

Regardless of whether one or both of first hot bus bar 22*c* and second hot bus bar 22*d* are included in the low voltage power receptacle assembly 10, neutral electrical contact 72*a* is at least partially compressed between an inboard surface of neutral bus bar 22*a* and an outboard surface of outboard wall portion 56*b*, thereby making an electrical connection to neutral bus bar 22*a*. In the illustrated embodiment, no electrical connections are made to ground bus bar 22*b* by low voltage transformer assembly 24, although it is envisioned that such a connection could readily be made, if desired, in a substantially similar manner as described above for making electrical connections to neutral bus bar 22*a*, first hot bus bar 22*c*, and second hot bus bar 22*d*.

Thus, with electrical bus bars 22 installed at isolator body 26, which in turn is installed at low voltage transformer assembly 24, which in turn is installed at rear housing piece 18*b*, each electrical bus bar 22*a-d* is received in a respective channel or space (62, 66, 74*a*, 74*b*) defined between two adjacent upstanding walls (54, 56*a*, 56*b*, 76*a*, 76*b*), thus ensuring that electrical bus bars 22 remain electrically insulated and/or isolated from one another as they pass through cavity 20 of housing 18. Electrical connections made between electrical contacts 72*a-c* and respective ones of the electrical bus bars 22*a*, 22*c*, 22*d* are also made in the electrically isolated channels between non-conductive walls, thus ensuring electrical isolation where the electrical connections are made.

To further ensure adequate electrical isolation, housing front piece 18*a* and housing rear piece 18*b* both include a plurality of inboard separation or divider walls 86 and a further plurality of outboard separation or divider walls 88 at the opposite end portions thereof, which cooperate to form power input coupler portion 20*a* and power output coupler portion 30*b* of low voltage power receptacle assembly 10.

As noted above, low voltage power receptacle assembly 10 in configured to be mounted in a modular electrical system such as that indicated at reference numeral 12 in FIG. 1, and to carry high voltage power to other areas of the system that utilize high voltage power, while simultaneously utilizing the high voltage power to provide a low voltage receptacle in the modular electrical system. It is envisioned that the low voltage power receptacle assembly of the present invention may be compatible for use in substantially any high voltage electrical system, including being adaptable for use in hard-wired or non-modular systems, without departing from the spirit and scope of the present invention.

FIGS. 16A-17B show various subcomponents or subassemblies of modular electrical systems, in order to illustrate various installation applications for low voltage power receptacle assembly 10. For example, in FIG. 16A, a power receptacle assembly 10 is electrically coupled to a four-wire junction block 86 via a two-way, four-wire connector 88. When the power receptacle assembly 10 and the four-wire junction block 86 are supplied with high voltage electrical power from a power source 89 (FIG. 1), junction block 86 provides access to the high voltage electrical power while low voltage power receptacle assembly 10 simultaneously provides access to low voltage electrical power.

Figures 16A, 16B, 16C, 16D:
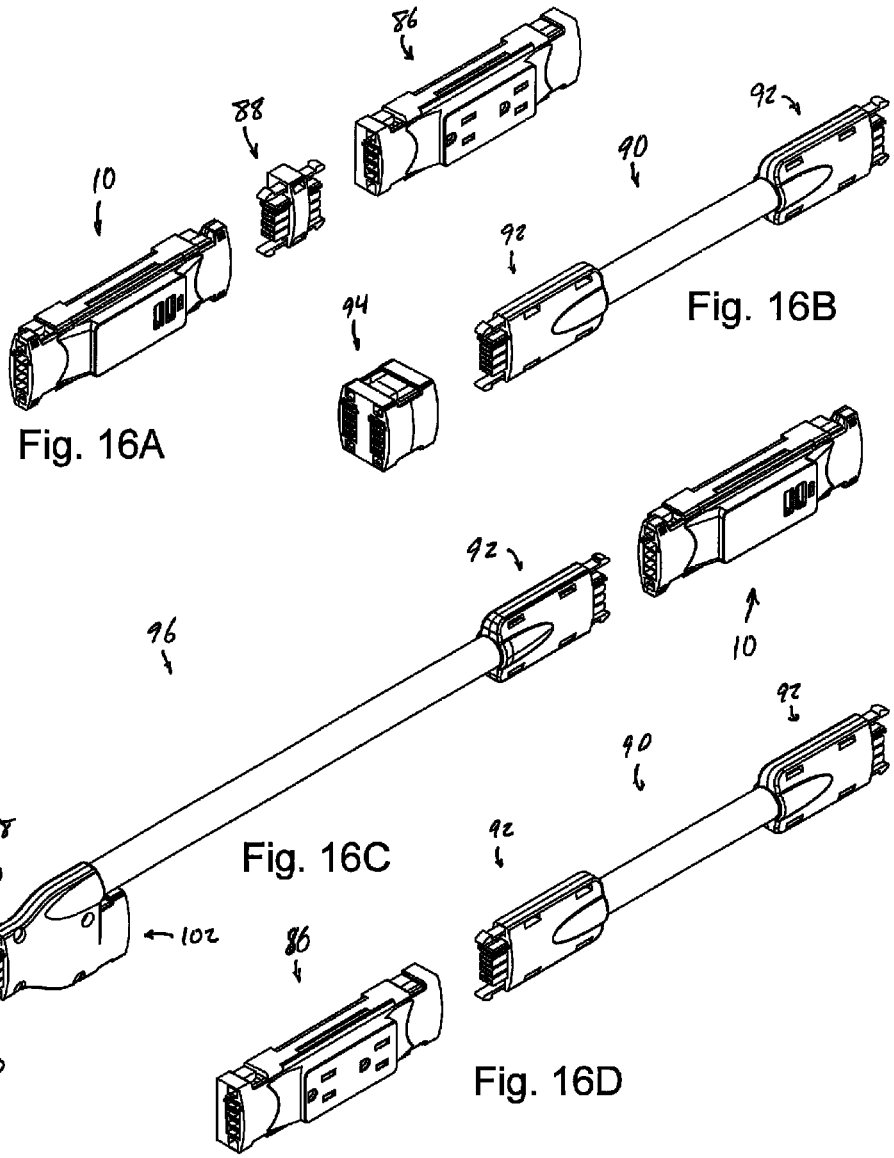
FIGS. 16A-16D are perspective views of various electrical cables and connectors that form portions of a modular electrical system that can incorporate the low voltage power receptacle.
Figure 17:
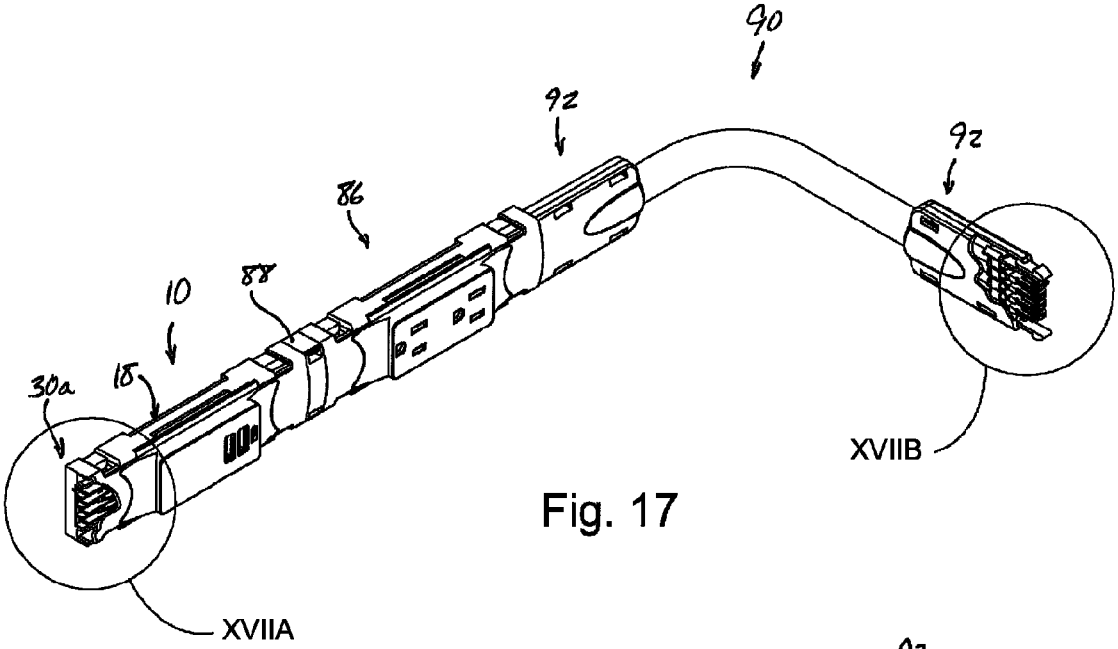
FIG. 17 is a perspective view of the low voltage power receptacle shown coupled to a portion of a modular electrical system.
Figure 17B:
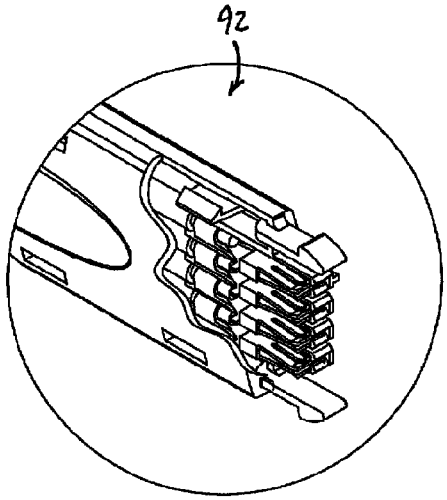
FIGS. 17A and 17B are enlarged views of the areas designated XVIIA and XVIIB, respectively, in FIG. 17.
Figure 17A:
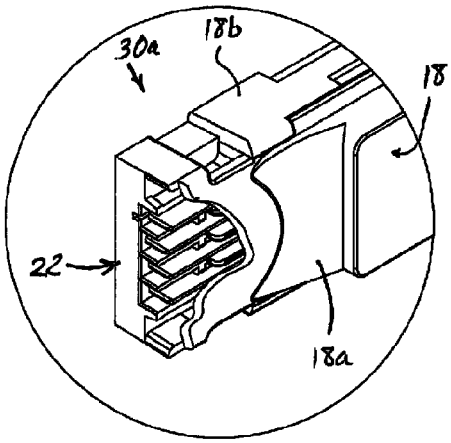

Optionally, and as shown in FIG. 16B, the power receptacle assembly may be coupled to a two-way, four-wire jumper cable assembly 90 having a pair of two-way, four-wire connector blocks 92 at its opposite ends, the connector blocks 92 being optionally connectable to a four-way, four-wire connector 94. In FIG. 16C, a power receptacle assembly 10 is arranged for connection to a three-way, four-wire jumper cable assembly 96 having a two-way, four-wire connector block 92 at one end for connection to power receptacle assembly 10, and further having a three-way, four-wire male/female jumper cable assembly connector block 98, including a female end connector portion 100 and a male end connector portion 102. Optionally, and as shown in FIG. 16D, another two-way, four-wire jumper cable assembly 90 is arranged for coupling one of its two-way, four-wire connector blocks 92 directly to a four-wire junction block 86, which can in turn be coupled to low voltage power receptacle assembly 10 via a two-way, four-wire connector 88, such as shown in FIG. 17. The various connectors and cables shown in FIGS. 1 and 16A-17B are more fully described in commonly-owned and co-pending U.S. patent application Ser. No. 13/647,992, filed Oct. 9, 2012 (U.S. Publication No. 2013/0095681), which is hereby incorporated herein by reference in its entirety.

While low voltage power receptacle assembly 10 is shown and described as being compatible for use in a two-circuit electrical system, it will be appreciated that the principles of the present invention may be adapted for single-circuit systems, or electrical systems having three or four or more electrical circuits, simply by scaling the low voltage power receptacle assembly as needed to accommodate the desired number of circuits, without departing from the spirit and scope of the present invention. It will further be appreciated that the specific arrangement or type of connectors may be adjusted as desired for substantially any application, or the receptacle assembly may be readily adapted for use in a non-modular system.

Optionally, and as shown in FIG. 14, a low voltage power receptacle unit may also include a high voltage power receptacle 104 (such as a 110V AC or 220V AC simplex receptacle), with receptacle openings 106*a-c* in a standard configuration and with respective conductors 108*a-c* electrically coupled to neutral bus bar 22*a*, ground bus bar 22*b*, and either first bus bar 22*c* or second bus bar 22*d*. This arrangement would provide users with access to both a standard high voltage power receptacle and one or more low voltage receptacles at the same power receptacle unit. Additional space and/or non-conductive isolation walls or the like may be provided so that there is sufficient packaging room for the additional receptacle, and to provide appropriate separation between high and low voltage conductors.

Accordingly, the low voltage power receptacle assembly of the present invention provides one or more low voltage power receptacles having a clean and permanent-looking appearance, such as in a work area, public space, or the like, without need for a low voltage wiring system that would be separate or distinct from a high voltage wiring system that may serve the same area. When incorporated into a modular electrical system that can be configured, reconfigured, and customized according to the needs of a particular area or user, the low voltage power receptacle assembly can be used to provide substantially any desired number of low voltage outlets in the same general area as high voltage outlets, and may even be installed in modular electrical systems having two or more electrical circuits.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A low voltage power receptacle assembly for use in a modular electrical system, said low voltage power receptacle assembly comprising:

a housing defining a cavity;

at least two electrical bus bars in spaced arrangement and extending through said cavity of said housing, at least one of said electrical bus bars configured to conduct a line voltage received from a power input, wherein an elongate space is defined between said electrical bus bars;

a low voltage transformer including at least two electrical contacts and a low voltage power receptacle, wherein said electrical contacts are configured to engage respective ones of said electrical bus bars, and wherein said low voltage transformer is positioned in the elongate space between said bus bars and is operable to transform the line voltage received at said electrical contacts to a lower voltage output at said low voltage power receptacle; and an isolator body configured to be received in said cavity of said housing, said isolator body comprising an elongate non-conductive wall disposed between said electrical bus bars.

2. The low voltage power receptacle assembly of claim 1, wherein said housing comprises a two-piece housing having a front housing piece and a rear housing piece, said front housing piece defining an opening that is substantially aligned to permit access to said low voltage power receptacle by an electrical connector.

3. The low voltage power receptacle assembly of claim 1, further comprising a coupler portion disposed at an end portion of said electrical bus bars and configured to engage an electrical connector in electrical communication with a power supply, whereby the electrical connector is configured to be electrically connected to said electrical bus bars at said coupler portion.

4. The low voltage power receptacle assembly of claim 3, wherein said housing defines said coupler portion.

5. The low voltage power receptacle assembly of claim 4, further comprising a second coupler portion disposed at an opposite end of said electrical bus bars and configured to engage a second electrical connector in electrical communication with a high voltage power outlet receptacle configured to carry the line voltage, wherein the second electrical connector can be electrically connected to said electrical bus bars at said second coupler portion.

6. The low voltage power receptacle assembly of claim 1, wherein said electrical bus bars comprise a hot bus bar and a neutral or ground bus bar, and wherein said electrical contacts of said low voltage transformer comprise a hot electrical contact and a neutral or ground electrical contact.

7. The low voltage power receptacle assembly of claim 6, wherein said neutral or ground bus bar comprises a neutral bus bar, said low voltage power receptacle assembly further comprising a ground bus bar spaced from said hot bus bar and from said neutral bus bar, and wherein a second elongate space is defined between said ground bus bar and at least one of said hot bus bar and said neutral bus bar.

8. The low voltage power receptacle assembly of claim 7, wherein said isolator body comprises a second elongate non-conductive wall disposed in said second elongate space.

9. The low voltage power receptacle assembly of claim 8, wherein each of said at least two electrical contacts of said low voltage transformer is positioned between one of said elongate non-conductive walls and a respective one of said electrical bus bars.

10. The low voltage power receptacle assembly of claim 9, wherein said at least two electrical contacts comprise compressible resilient contacts, and wherein each of said at least two electrical contacts is compressed between one of said elongate non-conductive walls and said respective one of said electrical bus bars.

11. The low voltage power receptacle assembly of claim 1, wherein one of said at least two electrical bus bars comprises a hot bus bar having a first or second configuration, and wherein said housing and said isolator body are configured to receive said hot bus bar in either of said first and second configurations.

12. The low voltage power receptacle assembly of claim 11, wherein said at least two electrical contacts of said low voltage transformer comprise first, second, and third electrical contacts, said first and second electrical contacts comprising hot contacts and said third electrical contact comprising a neutral or ground contact, and wherein (1) said first electrical contact is configured to electrically engage said hot bus bar in said first configuration while said second electrical contact remains electrically isolated, and (2) said second electrical contact is configured to electrically engage said hot bus bar in said second configuration while said first electrical contact remains electrically isolated.

13. The low voltage power receptacle assembly of claim 1, wherein the line voltage is about 110V AC or about 220V AC, and wherein the lower voltage output at said low voltage power receptacle is between about 2V DC and about 12V DC.

14. The low voltage power receptacle assembly of claim 13, wherein said low voltage power receptacle comprises a USB receptacle.

15. The low voltage power receptacle assembly of claim 13, further comprising a high voltage AC power receptacle.

16. The low voltage power receptacle assembly of claim 1, further in combination with a modular electrical system, said modular electrical system comprising:

a power supply line having at least one hot conductor, a neutral conductor, and a ground conductor, said power supply line having an upstream end portion configured to be electrically coupled to an AC power supply and a downstream end portion configured to be electrically coupled to said low voltage power receptacle assembly;

a power output line in communication with said power supply line via said bus bars of said low voltage power receptacle assembly; and a line voltage power receptacle electrically coupled to said power output line.

17. The low voltage power receptacle assembly of claim 16, wherein said power supply line of said modular electrical system comprises at least two hot conductors, and wherein only one of said hot conductors is in electrical communication with said hot bus bar of said low voltage power receptacle assembly.

18. A low voltage power receptacle assembly for use in a modular electrical system, said low voltage power receptacle assembly comprising:

a housing defining a cavity;

a plurality of electrical bus bars in spaced arrangement and extending through said cavity of said housing, said electrical bus bars having respective power input portions and power output portions, said electrical bus bars comprising:

a hot bus bar in one of at least two different shape configurations and configured to conduct a line voltage received from a power input;

a neutral bus bar configured to conduct the line voltage received from the power input; and a ground bus bar;

wherein a first elongate space is defined between said hot bus bar and one of said neutral and said ground bus bar, and a second elongate space is defined between said neutral bus bar and the other of said hot bus bar and said ground bus bar;

a low voltage transformer received in said cavity of said housing, said low voltage transformer including at least three electrical contacts and a low voltage power receptacle, wherein a first of said electrical contacts is configured to engage said neutral bus bar, and wherein when said hot bus bar is in a first of said at least two different shape configurations a second of said electrical contacts engages said hot bus bar while a third of said electrical contacts remains electrically isolated, and when said hot bus bar is in a second of said at least two different shape configurations said second electrical contact remains electrically isolated while said third electrical contact engages said hot bus bar;

an isolator body configured to be received in said cavity of said housing, said isolator body comprising a first elongate non-conductive wall disposed in said first elongate space and a second elongate non-conductive wall disposed in said second elongate space;

a power input coupler disposed at said input end portions of said electrical bus bars and configured to engage an electrical supply connector in electrical communication with a power supply, whereby the electrical supply connector can be electrically connected to said input end portions of said electrical bus bars; and a power output coupler disposed at said output end portions of said electrical bus bars and configured to engage an electrical output connector of a modular electrical system having at least one line voltage electrical receptacle that is electrically coupled to said electrical output connector, whereby the electrical output connector of said modular electrical system can be electrically connected to said output end portions of said electrical bus bars and to the power supply.

19. The low voltage power receptacle assembly of claim 18, wherein said isolator body comprises a generally rectangular wall defining a generally rectangular opening in which at least said low voltage power receptacle of said low voltage transformer is received.

20. The low voltage power receptacle assembly of claim 19, wherein said generally rectangular wall comprises at least one of said first and second elongate non-conductive walls.

* * * * *